United States Patent [19]

Radner et al.

[11] 4,100,749

[45] Jul. 18, 1978

[54] METHOD AND DEVICE FOR LINING CHAMBERS AND GALLERIES

[75] Inventors: Gerd Radner, Herne; Christoph Zillessen, Recklinghausen; Walter Zywietz, Dortmund; Franz Gantke, Dortmund-Kirchderne; Harald Walter, Dortmund, all of Germany

[73] Assignee: Runrkohle, A. G., Essen, Germany

[21] Appl. No.: 795,348

[22] Filed: May 9, 1977

[30] Foreign Application Priority Data

May 14, 1976 [DE] Fed. Rep. of Germany ..... 2621361

[51] Int. Cl.[2] ..... E21D 11/22

[52] U.S. Cl. ..... 61/45 C; 403/374

[58] Field of Search ..... 61/45 C, 45 R; 403/363, 403/366, 374

[56] References Cited

U.S. PATENT DOCUMENTS 3,076,672 2/1963 Heintzmann et al. ..... 61/45 C X

FOREIGN PATENT DOCUMENTS 961,723 6/1964 United Kingdom ..... 61/45 C

*Primary Examiner*—Paul R. Gilliam
*Assistant Examiner*—David H. Corbin
*Attorney, Agent, or Firm*—Andrus, Sceales, Starke & Sawall

[57] ABSTRACT

A method for lining chambers and galleries, especially mining and tunnelling galleries, employs resilient steel supporting frames which consist of a number of box-like section segments capable of being slid one into another and which thus, at least in the zone of overlap, constitute a closed tube. The ends of the overlapping segments are widened or compressed, as the case may be, and then inserted one into another. Each overlapping outer section segment is then mechanically compressed in the region of the overlap until ears of the so compressed segment grip behind flanges of the overlapped inner section segment. A self-locking wedge system providing means of restraint or braking is inserted between each two overlapping outer and inner section segments, and a leading tie and a deformation tie are fitted at the overlap region to the respective ends of the overlapping outer and inner section segments.

27 Claims, 8 Drawing Figures

METHOD AND DEVICE FOR LINING CHAMBERS AND GALLERIES

BACKGROUND OF THE INVENTION a. Field of the Invention

This invention relates to a method and an arrangement for lining chambers and galleries, especially mining and tunnelling galleries, with resilient steel supporting frames consisting of a number of box-like segments capable of being slid into one another and which thus, at least in the zone of overlap, constitute a closed tube.

b. Description of the Prior Art

The resistance of the gallery lining to changes of shape, which are caused by displacements or other changes in position of the adjacent rock, depends with the resilient lining on the load bearing capacity of the lining sections and on the so-called insertion resistance of the resilient structural members. Lining elements are known which are used as a resilient lining in underground mining and tunnelling, and which consist of a number of section segments placed in one another in a like manner and which overlap in a certain region. In the region of overlap the section segments are pressed against one another by clamp connections. These connections have the task of bracing the section segments with a prescribed force, which is produced by screwing, so that when the lining frame is placed under load as the result of rock pressure, the frictional resistance of the mutually braced sections is only overcome at a value dependent on the bracing force. The lining arch then at any time thrusts inwards jerkily only by small amounts, whilst the section segments slide into one another. Such a lining is known, for instance, from German Patent Specification No. 1,201,285.

The insertion resistance obtainable with the known resilient lining amounts, according to measurements made also below ground, to 5 – 10 tonnes. These relatively unfavourable values come about because the connections used hitherto and working on the basis of frictional forces transmit the forces from the rock more or less unequally, because the friction values vary, the screws, clips and other fastening elements stretch under the loads applied, the structural elements have dimensional inaccuracies, or the clips become slack and change their position. Moreover, the serviceability is affected by the carefulness of the service personnel, as the section segments are braced mutually and placed in one another in a like manner in the region of overlap, and adequate overlaps and satisfactory stressing force must be allowed for without fail when tightening the tie nuts. The measurements already cited show, however, that as a rule the frictional forces generated by the bracing lead to only a small insertion resistance.

Again and again it has been sought to raise the insertion resistance by improvements and modifications to the connecting elements. Further, in regard to mining there is the requirement to make the load bearing capacity, determined by the insertion resistance, adjustable or at least capable of being affected by suitable devices. Such endeavours are, however, rendered difficult in that the lining used in mining and tunnelling must be simple, robust and practical.

A steel section is now known of approximately U-shaped cross-section having a section bottom with webs and flanges slightly inclined to one another toward the open section side. At its longitudinal sides, the section bottom of this section passes into a graduation directed to the open section side, to which webs are attached. The flanges strengthening the webs point to one another. When assembling the steel section into a lining frame, the steel section segments overlapping at the connecting ties, respectively strengthening points, are pushed one into the other in an unlike manner. During the insertion, the inner surfaces of the flanges of the outer steel section segment correspond with the outer flanges of the graduations of the inner steel section segment, whilst the flanges of the inner steel section segment bear against the inner surfaces of the section bottom of the outer steel section segment, and in the region of the webs there results an off-thrust against one another as well as against the inner surfaces of the graduation of the section bottom. In this way an insertion resistance, which is, however, not capable of being determined precisely beforehand, is generated on insertion. A steel section of this type suitable for lining frames is disclosed in German Patent Application No. P 25 50 577.5.

In order that the sections can be fitted into each other, the end of one steel section segment is sufficiently widened for the end of the steel section segment to be inserted, which is compressed for better fitting, to be pushed in easily. When inserting the compressed inner segment into the widened outer segment, a resistance to a change of shape in the rolled section, which makes the insertion much more difficult and thus sets up a marked insertion resistance, must be overcome.

Trials with lining frames of this kind have shown, however, that the insertion resistance is not adequate. It is only slightly above or equal to that of the known lining with sections lying inside one another in a like manner.

SUMMARY OF THE INVENTION

The invention is directed towards affording a method and an arrangement by means of which a lining can be created having an insertion resistance considerably above that hitherto attainable. In addition, the insertion resistance must be adjustable to the greatest extent possible.

This problem is solved by the invention in that the ends of the section segments are widened or compressed as the case may be and then inserted into one another, whereupon the outer section segment is again mechanically compressed in the region of overlap until the ears of the outer section segment grip behind the flanges of the inner section segment, and in that means of restraining or braking are inserted between the outer and the inner section segments, and the actual ends of the sections are provided with ties in the overlap region. The outer and inner segments are on each occasion brought to the length required, bent and widened at the ends, or compressed at one end as the case may be, before delivery. As with linings hitherto, struts and head-piece segments must be prepared and kept apart from one another during installation below ground. During the recompression of the outer segments in accordance with the invention, the insertion resistance is already noticeably raised as compared with leaving them in the state of delivery, as the friction between the parts of the inner and outer segments in contact with one another becomes effective at once with the slightest amount of shifting. The wedge system and the ties serve to increase further the insertion resistance and to adjust it as planned, according to requirements. Preferably a wedge system providing the restraining means is pushed between the ears of the inner section and the flanges of the inner and of the outer section. By applying the wedge system, the flanges of the outer and inner sections are further restricted during insertion. The ties, which are attached to the ends of the section segments, prevent buckling or bulging of the outer section. This ensures that during insertion sufficient work of deformation must always be carried out. Altogether, the new lining method offers the advantage that a lining with an insertion resistance of over 50 tonnes can be produced. Because of the improved rigidity arising from its special profile, the lining itself can be lighter than the previous lining with an approximately semi-circular profile. For this reason, the lining as a whole is more advantageous in regard to costs, as any possibly higher rolling costs can be recouped by the lower material costs.

Manufacture of the outer and inner section segments is simplified by the invention in that the outer section segments, widened over their entire length, are at all times compressed again over their entire length, whilst the inner section segments, compressed throughout their entire length, are left in that condition. The rolling process is certainly slightly lengthened by this, but technically simplified, because the process of compressing or widening does not have to be interrupted on each occasion.

The rock pressure conditions to be met vary widely. The pressure conditions often change over a length of a few meters, so that the strength of the lining must theoretically be constantly modified or, as the case may be, when changes occur after installation, additional lining must be applied, or the entire gallery repaired. The latter is often the case because organisationally and on account of the transporting of materials it is not possible continually to modify the strength of the lining. Added to this, the pressure conditions change in a way that cannot be planned for beforehand because of the mining of the adjacent coal. In order to avoid these problems, a substantially stronger lining than is strictly necessary is usually employed. The costs thereby incurred are considerable. The reason for these problems is that the insertion resistance of the lining cannot be varied or can only be varied to a very slight extent. It is for the most part only achieved in its upper limit. The upper limit is, however, only reached by the work personnel when installing the lining under the best conditions and with faultless handling. In order to make the lining suit the actual pressure conditions, it is suggested according to the invention that when a high insertion resistance is required, a wedge system of greater length and smaller inclination and/or a shorter wedge with greater inclination is used, and when a low insertion resistance is required a short wedge system and/or a wedge with a slight inclination is used. With a long wedge, the friction forces and thus also the insertion resistance are higher. Likewise the slope of the wedge, which can be driven between the ears of the inner section, affects the insertion resistance. All in all, the insertion resistance can be affected and adjusted by the shape and length of the wedge system or of the wedge. The lining as a whole does not have to be adapted to the changing rock conditions and it is merely necessary to insert wedges of different shape or slope.

With the lining known hitherto, the ties have a preponderant importance, because the section segments placed inside one another in like manner press against one another and thus establish the insertion resistance. According to the method of the invention, the insertion resistance can also be established by the enclosing force of the ties. However, only the enclosing force of the deformation tie is decisive, i.e. of the tie which is seated above the end of the inner section segment surrounded by the outer section segment and which establishes, or at least decisively affects, the cross-section through which the inner section segment must force itself if the lining thrusts inwardly because the prescribed insertion resistance has been exceeded. The enclosing force of the leading tie, on the other hand, needs to be only sufficiently great for the outer section segment to be held together. With the deformation tie on the other hand, in the situation described above, the deformation work to be accomplished during insertion, and thus the insertion resistance, is established.

The outer section segment is again compressed in the overlap region after the inner section segment is placed in it. In order to simplify this process in the restricted conditions beneath the surface, it is suggested, according to a preferred feature of the invention, that the outer section segment should be compressed in the region of the installation overlap by means of hydraulic grippers or a clamping device and/or over a, for example, hydraulically-operated drawing or clamping device when applying the subsequent tie. In this connection, the simultaneous compression by clamping device and tie is especially recommended as then the forces to be applied from each device may be reduced.

For practical production reasons, the other section segments are widened either over their entire length or at least at both ends. In order also to be able to produce and use the segments of a four-part lining in the same manner, it is provided by another preferred feature of the invention that with all lining frames in which the number of segments is divisible by two a short connecting element consisting of a compressed section should be inserted. The two widened segment ends can thus be joined together easily and the basic lining itself remains uniform.

After rolling, the box sections are usefully further processed on the surface, i.e. separated into suitable lengths and then bent. This work can, however, also be undertaken below ground. These operations should, however, be carried out as far as possible in the production of the specific frame. It is, therefore, proposed according to a further preferred feature of the invention that the box-like section segments should be widened or compressed as the case may be simultaneously with deformation by the bending device. The equipments required for processing the lining are therefore to be slightly modified.

The problem is solved and the method according to the invention is accomplished by a lining and an arrangement in which the box-like section segments can be inserted into one another in an unlike manner, whilst a leading and a deformation tie, as well as means of retarding, insertable between the section segments inserted into one another, are provided in the overlap zone. The box shape of the sections is particularly suitable because it has several contact surfaces at which, supported by the ties and means of restraint, so much friction is caused on insertion that an insertion resistance of over 50 tonnes can be obtained. Because of the box shape and of the tubular shape obtained at least in the region of overlap, such a lining frame is both more rigid and more resistant to distortion than previous lining frames. The accessories, such as bolts and mats, required for lining excavations can be easily fixed because of the box shape.

According to the invention, a self-locking wedge system and/or retractable wedges act as the restraining means. The wedge system and the retractable wedge hinder the insertion into one another of outer and inner segments. With the wedge shape having a slope of more than 6°, the entire system is to be designated self-locking.

Single parts and accessories of the lining are easily lost below ground. For reasons of rationalisation, the lining parts are preferably delivered in sets. Small parts are inconvenient. In order also to simplify handling and make it more reliable, so that the wedges acting as restraining means are correctly inserted, according to the invention the wedge system may be designed in a comb-like manner and can be introduced over the flanges of the inner and outer section segments.

According to a further embodiment of the invention, to improve handling it is also suggested to broaden the comb-like wedge system by a wedge part which can be inserted between the ears of the inner section segment. A special advantage of this is that another single part can be omitted.

The insertion resistance may also be altered after installation, i.e. when the pressure conditions in the rock have changed as a result of mining, by using wedge systems with a different length or slope. But even without replacing the wedge system subsequent alteration of the insertion resistance is possible if, as previously suggested, the retractable wedge has a drawing or thrusting device. With this the position of the retractable wedge between the ears of the inner section segment can be changed as required.

According to another embodiment of the invention, the retractable wedge has a slope corresponding to the desired insertion resistance both in the direction of the retraction and of the insertion of the segments. By means of this a double mode of action of the retractable wedge is obtained.

It may become necessary to change the insertion resistance at short notice. It is, therefore, useful to keep in stock different sorts of wedge systems. In order to be able to distinguish these from one another easily and quickly, it is suggested that the wedge systems and the retractable wedge should be distinguished by colour or suitable markings according to the insertion resistance to be obtained.

The lead tie has the task of preventing the outer section segment from curling up. In order to do this it must be carried along in each case from the end of the section. This is effected according to the invention by giving the lead tie a collar which grips the face of the end of the outer section segment. The collar ensures in an advantageous manner that the lead tie is carried along always on insertion of the outer section segment.

It is likewise necessary to make sure that the deformation tie stays in place over the section end of the inner segment, as the cross-section through which the inner section must force itself is set by it. To make certain of this, the deformation tie according to the invention possesses stop elements which prevent it being displaced outwards over the inner section.

According to the results of trials, to achieve the desired aims it is sufficient to use simple strip iron for both lead and deformation ties. Because of general safety regulations, it is, however, desirable to make the ties more stable. A particularly good effect is obtained if, as the invention provides, the ties are adapted to the profile of the segments.

The widened outer section segment is compressed again by a mechanical device after installation. According to a further embodiment of the invention, the clamping device is of spring steel, i.e. a number of spring steel clamps are placed on the part of the outer section segment to be compressed and a compression is thus brought about. The resilient force of the clamps is in this connection greater than the force required for the compression.

After rolling, the box-like section segments are bent into the prescribed curved shape on a bending device. For this purpose, they pass through, for example, an arrangement consisting of a number of roller systems until they have attained the prescribed shape. On account of the restricted conditions beneath the surface, curved segments are also usefully widened or compressed as the case may be above the surface. In order to avoid large investments, according to a preferred feature of the invention the bending device is extended by an equipment which widens or compresses the section segments. It is an advantage that in this way deformation of the box-like section is not saddled with too high costs.

The equipment may be improved further by being composed of a roller system which is shaped after or adapted to the shape of the box sections and which widens or compresses the box section gradually.

According to another useful embodiment of the invention, the bending equipment and the additional equipment have the same drive.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
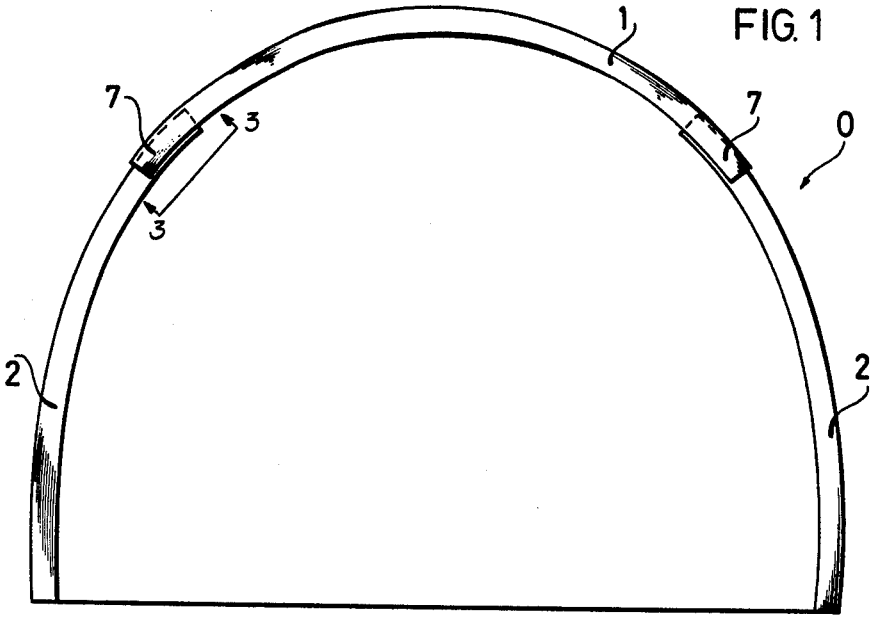
FIG. 1 illustrates in a schematic fashion the essential form of a three-part steel lining arch.

The three-part gallery lining arch O shown in FIG. 1 consists of two strut inner section segments 2 and a head-piece outer section segment 1. Arches O of this sort are assembled underground from the three component segments 1,2 and installed in such a way that they stand normal to the stratification and as close to the wall face of the gallery as possible. The upper ends of the two inner section segments 2 are compressed, so that the widened ends of the outer section segment 1 can be fitted over them, or the ends of the inner section segments 2 inserted into the widened outer section segment ends 1. The overlap regions 7 of the segments can be widely adapted to suit the actual conditions, for instance if too much wall rock has been shot out or broken back into or, contrariwise, if too little has been shot out. The maximum amounts are, however, prescribed by the shape of the arch.

Figure 2:
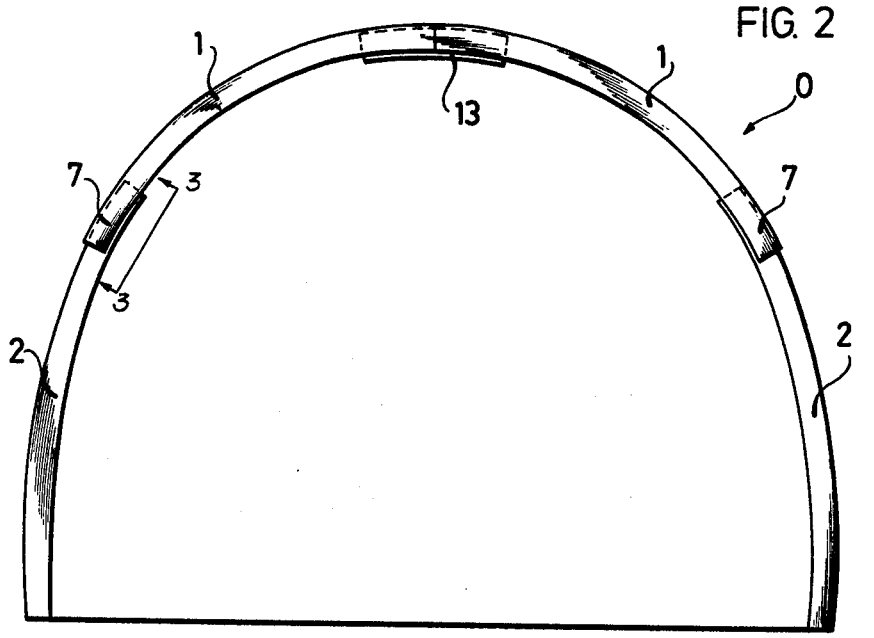
FIG. 2 illustrates in a schematic fashion the essential form of a four-part steel lining arch.

FIG. 2 shows a four-part lining arch O which is composed of two inner and two outer section segments 1,2. At the ridge two widened outer section segments 1 abut one another. The lining arch is joined together by a connecting element 13 which consists of a compressed inner section piece which can thus be inserted into the widened ends of the outer section segments 1. Usually, mutual insertion of the segments in the ridge zone is not necessary, or even not desired. For that reason, the widened ends can abut against one another without having to be compressed after installation. The connecting element 13 then serves merely to make the connection. If, on the other hand, insertion of the segments is made possible in the ridge zone as well, a connecting element 13 having a length corresponding to that of the expected amount of insertion is used. In the latter case, as in the other regions of overlap, lead and deformation ties are used, whilst in the case of a rigid connection simple retaining ties or iron strips are enough to hold the ends of the outer section segments 1 together.

Figure 3:
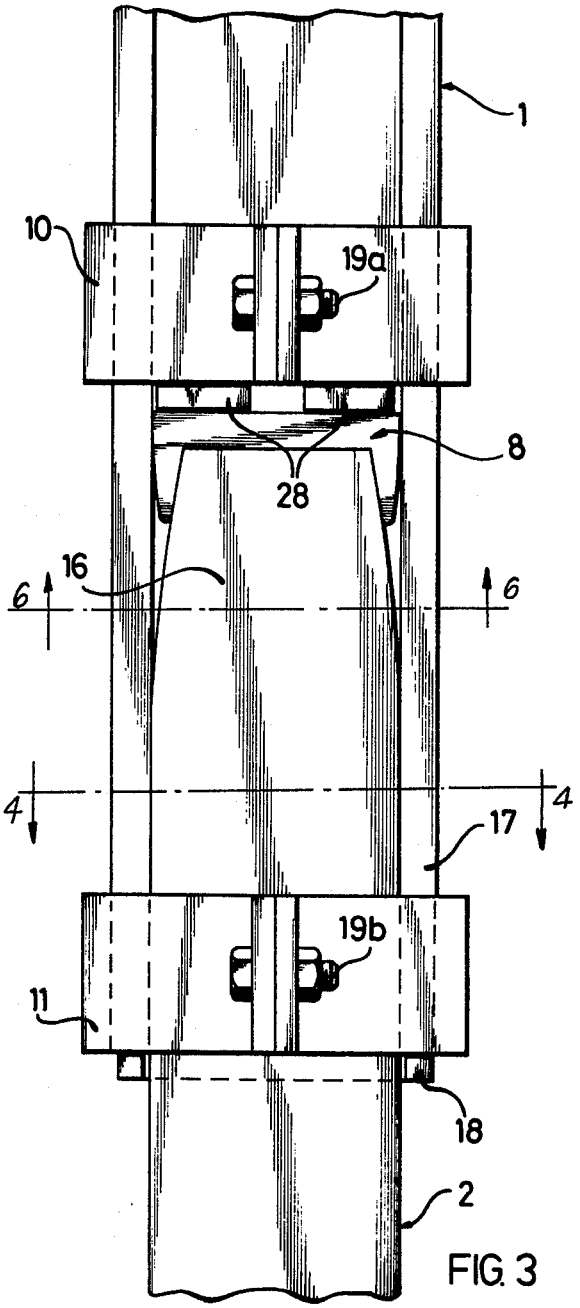
FIG. 3 illustrates a partial view of an overlap region of two section segments the region in which the view is taken being indicated by the line 3 — 3 in FIGS. 1 and 2.

A view of an overlap region is shown in FIG. 3. A deformation tie 10 and the lead tie 11 are placed on the already re-compressed outer section segment 1, into which the inner section segment 2 is inserted. Ties 10,11 are held together by screws 19*a*, 19*b*. Deformation tie 10 has stop elements 28 which prevent movement outwards over the inner section segment, so that it does not change its position in respect of the inner section segment end being inserted. The fixed position of the deformation tie is important because it determines the cross-section through which the compressed inner section segment 2 must be forced during insertion.

Lead tie 11 is seated on the end 17 of the outer section segment 1 and carries a collar 18 in order to ensure that the lead tie 11 always remains over the end 17 and is not displaced by the inner section segment 2 being inserted.

End 16 of the inner section segment 2 is compressed. For technical drawing reasons and in order to make this abundantly clear, the region in which segment 2 is compressed is drawn shortened. On end 16 is placed the wedge system 8, which prevents or restricts insertion to the desired extent, so as to obtain the prescribed insertion resistance. The sides of the wedge system 8 have a slope of at least 6° so that self-locking is achieved and ensured and the wedge system 8 is not thrown off during "jerky" insertion.

Figure 4:
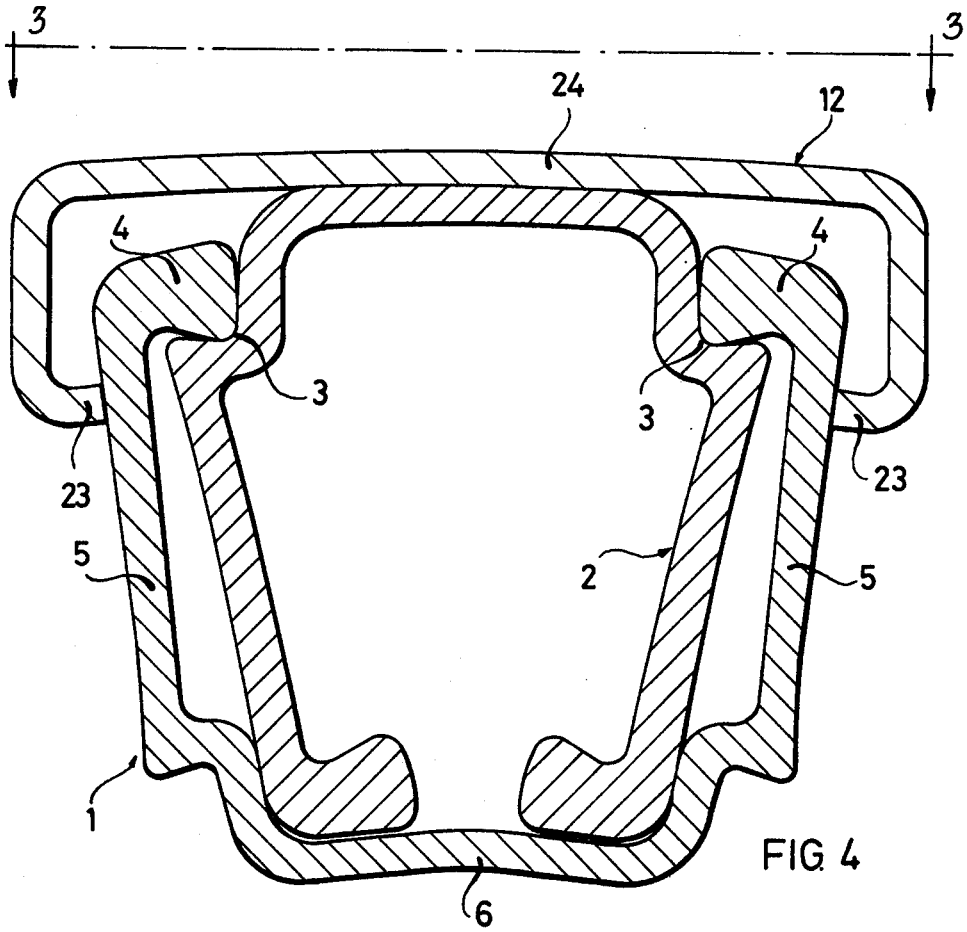
FIG. 4 illustrates a steel section in cross-section with associated clamp, the view being taken through a section corresponding to that indicated by the line 4 — 4 in FIG. 3.

After the mutual insertion of outer and inner section segments, the sides 5 of the outer section segment 1 are compressed once more by a device so that ears 4 of the outer section segment 1 engage behind flanges 3 of the inner section segment. This compression can also be effected by one or more clamps 12 of, for example, spring steel (FIG. 4), in which case the clamp is also usefully left in place after completion of the whole of the lining arch. The clamp 12 is prevented from slipping off by the surfaces of clamp 12 to be placed on the outer section segment 1, having a slope similar to sides 5, or by the ends 23 of the clamp being bent towards the bottom 24 of the clamp.

Figure 5:
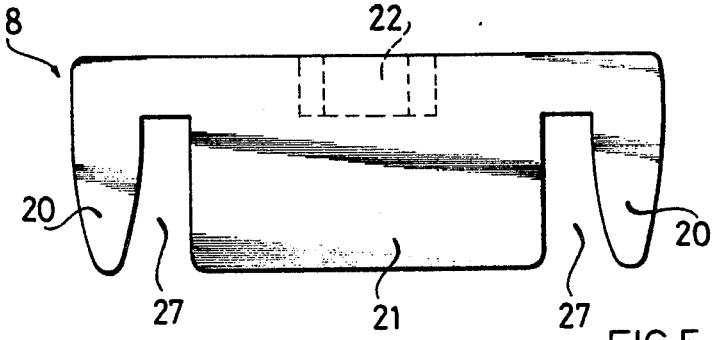
FIG. 5 is a side view of a wedge system.

FIG. 5 shows a wedge system 8 which, for example, consists of two outer wedges 20 and a connecting part 21. For manufacturing reasons, this connecting part 21 is solid, but it can also be hollow or open underneath. On the continuous side of the wedge system 8 a recess 22 is provided in which a part 25 of the lifting and pulling device 14 of retractable wedge 9 can be guided.

Figure 6:
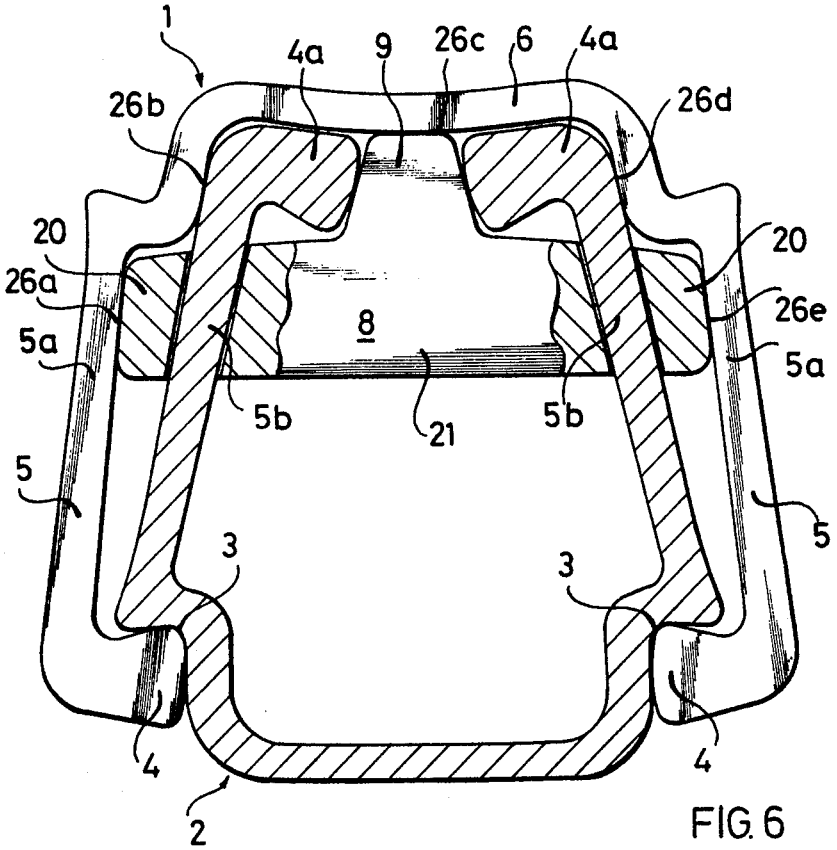
FIG. 6 illustrates the steel section in cross-section with the wedge system, the view being taken through a section corresponding to that indicated by the line 6 — 6 in FIG. 3.

FIG. 6 shows the position of the wedge system 8, a retractable wedge 9 being integrated into the wedge system. After mounting the lining arch, in the hollow space between sides 5*a*,5*b*, of the outer and inner section segments 1,2 and the ears 4*a* of inner section segment 2, the wedge system is mechanically compressed or driven until it has attained the requisite height or position for the insertion resistance aimed at. Friction surfaces 26*a*–26*e* are created by driving in wedge 8,9. The flattened tip of wedge 9 or wedge part 9 abuts against bottom 6 of the outer section segment 1. When wedge system 8 is driven in, it is forced with the notches 27 on to side 5*b* of the inner section segment 2, whereby the position of the wedge system 8 is further secured.

Figure 8:
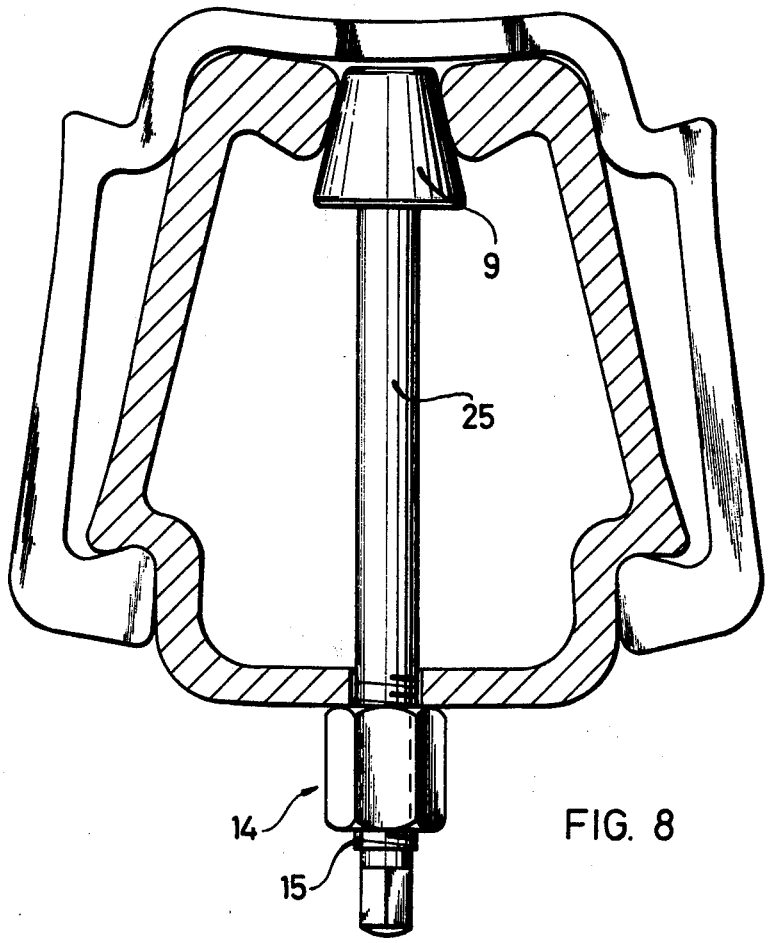
FIG. 8 shows a retractable wedge with pull and push device.

The retractable wedge 9 is, however, not necessarily integrated into the wedge system. FIG. 8 shows a retractable wedge 9 the position of which can be varied by a lifting and pulling device 14. Part 25, which connects the lifting and pulling device 14 with the retractable wedge 9, is then usefully engaged in the recess 22, illustrated in FIG. 5, of the wedge system 8 which is not shown here. A useful, because simple, embodiment of the lifting and pulling device 14 is a nut seated on the end of part 25, provided with a thread 15.

Figure 7:
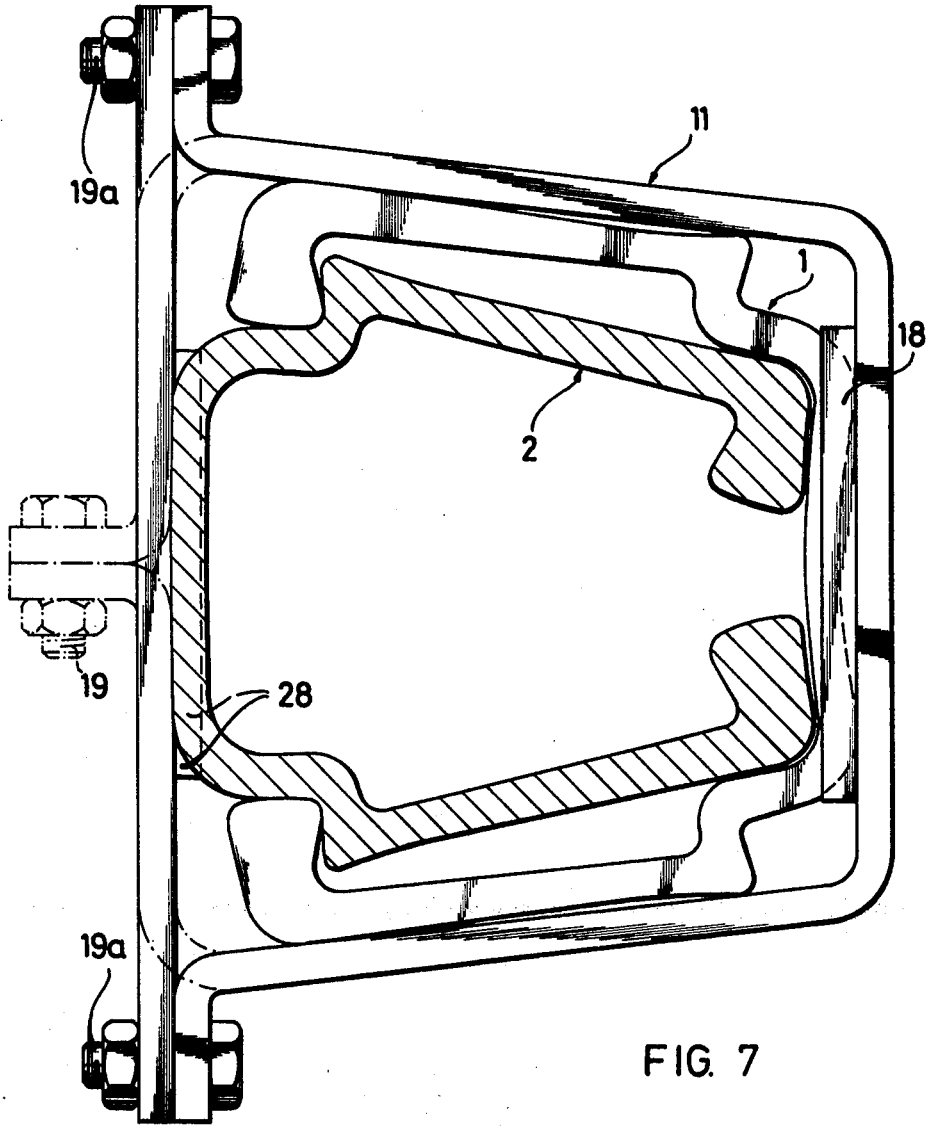
FIG. 7 is a cross-section of the steel section with lead tie.

A lead tie 11 is shown in FIG. 7. Such ties may consist of two parts and two screws 19*a* or of one part and one screw 19. Both types of tie are indicated in the drawing, a tie being reproduced in both cases which is suited to the shape of the box section of the lining. In order to ensure that the lead tie 11 always remains at the end of outer section segment 1, lead tie 11 carries a collar 18. Because of collar 18, the outer section segment 1 being inserted carries the lead tie along with it, thus preventing undesired opening of the outer section segment 1. The same holds good for deformation tie 10, which has a stop element 28 ensuring that the deformation tie always retains its position over the end of the compressed inner section segment.

We claim:

1. A method for lining chambers and galleries, especially mining and tunnelling galleries, with a deformable frame including first and second segments having end portions, one of which is capable of being slid into another for joinder, said segments having a generally C-shaped cross section with a pair of arms joined by an intermediate connection member having an exterior flange, said method comprising the steps of:

altering the cross-sectional configuration of the end portion of at least one of the segments for permitting sliding joinder of said second segment into said first segment;

inserting the end portion of the second segment into the end portion of the first segment with the C-shaped sections of the segments opening in opposite directions to form a closed tube in the region of the overlapped end portions;

positioning a wedge means in operative association with the overlapped end portion of at least the second segment for placing the overlapped end portions of said first and second segments in frictional engagement and to establish, at least in part, a predetermined resistance to further insertion of the second segment into the first segment;

placing the arms of the first segment in abutment with the sides of the flange of the connecting member of the second segment; and peripherally compressing the first and second segments, at least adjacent to the area of frictional engagement of said end portions, to further establish the predetermined insertion resistance.

2. A method according to claim 1 wherein the initial step is further defined as contracting the cross-sectional configuration of at least the end portion of the second segment for permitting sliding joinder of the segments.

3. A method according to claim 2 wherein the initial step is further defined as including expanding the cross-sectional configuration of the first segment along its entire length and wherein the step of placing the arms of the first segment in abutment with the flange of the second segment is further defined as contracting the cross section of the first segment along its entire length.

4. A method according to claim 1 wherein said wedge means comprises a wedge system and the positioning of the wedge means is further defined as inserting wedge elements of the system between the overlapped end portions of the first and second segments.

5. A method according to claim 4 wherein the positioning of the wedge means is further defined as inserting a wedge element of the system between the arms of said second segment.

6. A method according to claim 5 wherein the magnitude of insertion resistance is determined at least in part by the configuration of the elements of the wedge system and the method includes the step of selecting the configuration of the inserted wedge elements in accordance with the degree of insertion resistance desired.

7. The method according to claim 6 wherein the length and slope of the inserted wedge elements are selected in accordance with the degree of insertion resistance desired.

8. A method according to claim 1 wherein said wedge means comprises a wedge and the positioning of the wedge means is further defined as inserting the wedge between the arms of said second segment.

9. A method according to claim 8 further defined as altering the amount of insertion to determine, at least in part, the amount of insertion resistance.

10. A method according to claim 1 wherein the magnitude of the peripheral compression of the first and second segments is selected in accordance with the desired degree of insertion resistance.

11. A method according to claim 3 wherein the peripheral compression of the first and second segments occurs simultaneously with the contraction of the cross section of the first segment.

12. The method according to claim 1 wherein the altering of the end portions of the first and second segments is carried out simultaneously with the deformation of the segments to form them into the shape of the frame.

13. A method according to claim 1, wherein the number of segments in the lining frame is a multiple of two, and a short connecting element consisting of a compressed section is inserted at the middle of the frame.

14. A supporting frame for lining chambers and galleries especially mining and tunnelling galleries, said frame comprising:

at least first and second supporting frame segments forming said frame, each of said segments having a generally C-shaped cross section with a pair of arms joined by an intermediate connection member having an exterior flange, at least one of said segments having an altered cross-sectional configuration at an end portion thereof, said segments being slid together at said end portions with said second section inside said first section and the C-shaped sections opening in opposite directions to form a closed tube in the region of overlap, the arms of said first segment compressively engaging the flange of said connecting member of said second segment;

frictional engagement means operatively associated with at least said second segment for frictionally engaging said end portions for establishing, at least in part, a predetermined resistance to further insertion of said second segment into said first segment; and tie means surrounding said first member, normal to the direction of insertion and adjacent the location of said frictional engagement means, said tie means compressively engaging said first member to further establish the predetermined insertion resistance.

15. A frame according to claim 14 wherein said frictional engagement means comprises a wedge system having wedge elements inserted between the overlapped end portions of said first and second segments.

16. A frame according to claim 15 wherein said wedge system has a wedge element inserted between the arms of said second segment.

17. A frame according to claim 16 wherein the length and slope configuration of said wedge elements are formed in accordance with the desired insertion resistance between said segments.

18. A frame according to claim 15 wherein said wedge system includes spaced, generally parallel extending wedge elements and an element intermediate said wedge elements positioned in the interior of said second member.

19. A frame according to claim 14 wherein said frictional engagement means comprises a wedge insertable between the arms of said second segment.

20. A frame according to claim 19 wherein said frictional engagement means further has means for controlling the amount of insertion of said wedge between said arms.

21. A frame according to claim 19 wherein said wedge is of increasing dimension in a direction opposite to that of insertion and wherein the amount of slope is selected in accordance with the desired insertion resistance between said segments.

22. A frame according to claim 15 wherein said wedge is provided with distinguishing markings according to the configuration of said wedge elements.

23. A frame according to claim 21 wherein the wedge has identifying indicia indicative of the amount of increased dimension of said wedge.

24. A frame according to claim 14 wherein said tie means includes a pair of ties, one of said ties being adjacent the end of said first segment, a second of said ties being adjacent the location of said frictional engagement means, said ties having means for retaining them in position.

25. A frame according to claim 14 including at least one clamping means applied to the arms of said first segment to obtain engagement of said arms with the flange of said second segment.

26. A frame according to claim 25 wherein said clamping means comprises a spring steel clamping means.

27. A frame according to claim 14, wherein the tie means are adapted to the cross sectional configuration of the segments.

* * * * *